US007191963B2

(12) United States Patent
Cobianchi et al.

(10) Patent No.: US 7,191,963 B2
(45) Date of Patent: Mar. 20, 2007

(54) FUEL INJECTOR WITH HYDRAULIC PIN ACTUATION

(75) Inventors: Andrea Cobianchi, Bologna (IT); Fabio Cernoia, Zola Predosa (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 143 days.

(21) Appl. No.: 10/983,905

(22) Filed: Nov. 9, 2004

(65) Prior Publication Data

US 2005/0103882 A1 May 19, 2005

(30) Foreign Application Priority Data

Nov. 14, 2003 (IT) ..... BO2003A0678

(51) Int. Cl.
*F02M 51/00* (2006.01)

(52) U.S. Cl. ..... 239/585.1; 239/96; 239/585.3; 239/585.5; 239/900; 251/129.1; 251/129.09; 335/256; 335/266; 335/267

(58) Field of Classification Search ..... 239/88, 239/96, 124, 584, 585.1, 585.3, 585.5, 900; 123/294; 251/129.1, 129.09, 129.16; 335/256, 335/266, 267
See application file for complete search history.

(56) References Cited

U.S. PATENT DOCUMENTS 4,964,571 A * 10/1990 Taue et al. ..... 239/88
5,494,219 A 2/1996 Maley et al.
6,113,014 A * 9/2000 Coldren et al. ..... 239/585.1
6,913,206 B2 * 7/2005 Cobianchi et al. ..... 239/96
2002/0166541 A1 11/2002 Yamakado et al.

FOREIGN PATENT DOCUMENTS

| | | | |
|---|---|---|---|
| EP | 331198 | A2 * | 9/1989 |
| EP | 0 331 200 | B1 | 5/1995 |
| EP | 0 976 923 | A2 | 2/2000 |
| EP | 1 130 249 | A2 | 9/2001 |
| EP | 1 387 077 | A1 | 2/2004 |
| GB | 1 567 042 | A | 5/1980 |
| GB | 2 341 839 | A | 3/2000 |
| JP | 02218859 | A * | 8/1990 |

* cited by examiner

*Primary Examiner*—Kevin Shaver
*Assistant Examiner*—Jason Boeckmann
(74) *Attorney, Agent, or Firm*—Berenato, White & Stavish

(57) ABSTRACT

The injector has a cylindrical body, which houses an injection nozzle regulated by an injection valve provided with a moveable pin, a fuel supply line, an injection chamber communicating with the supply line, housing a lower portion of the pin and delimited below by a valve seat of the injection valve, a control chamber communicating with the supply line and housing an upper portion of the pin, and a control valve, which is capable of putting the control chamber in communication with a drain for the low-pressure fuel and is controlled by an electromagnetic actuator provided with a pair of electromagnets identical with each other and arranged mechanically in series with each other so that their respective thrust forces are added together.

26 Claims, 6 Drawing Sheets

FUEL INJECTOR WITH HYDRAULIC PIN ACTUATION

The present invention relates to a fuel injector with hydraulic pin actuation.

BACKGROUND OF THE INVENTION

Fuel injectors with electromagnetic pin actuation are commercially available, and they differ greatly in how they combine good performance and modest cost. An injector with electromagnetic pin actuation is provided with an valve injection having a valve seat, which ends in an injection nozzle and is coupled with a pin capable of being displaced from a position where the valve seat is closed to a position where the valve seat is open by a thrust by an electromagnetic actuator and against the action of a spring capable of holding the pin in the closed position; in particular, the actuator comprises an electromagnet capable of displacing the pin from the closed position to the open position against the action of the spring.

Injectors with electromagnetic pin actuation work very well with low to medium fuel pressures, while critical situations can arise with high fuel pressures since the electromagnet may not be able to produce sufficient force to open the injector in short periods of time; for this reason, injectors with hydraulic pin actuation have been proposed, i.e. injectors in which the displacement of the pin from the closed position to the open position against the action of the spring happens through the effect of hydraulic forces.

An example of an injector with hydraulic pin actuation is provided by patent application EP-1036932-A2 or patent application EP-0921302-A2, in which a lower portion of the pin is housed in an injection chamber, which is delimited below by the valve seat of the injection valve, and an upper portion of the pin is housed in a control chamber, which houses the spring that keeps the pin in the closed position; fuel is fed constantly at pressure either to the injection chamber, which it leaves through the injection nozzle when the pin is in the open position, or to the control chamber. The control chamber is coupled to a control valve, which is actuated by an electromagnetic actuator so as to be displaced against the action of a control spring between a closed position and an open position, in which it puts the control chamber in communication with a low-pressure drainage environment. In use, when the control valve is closed, the pressure of the fuel in the control chamber is equal to the pressure of the fuel in the injection chamber, and the pin is held in the closed position either by the action of the spring or by the hydraulic force that is generated when the area of the pin subject to the action of the fuel is greater in the upper portion housed in the control chamber than in the lower portion housed in the injection chamber. When the control valve is open, the pressure of the fuel in the control chamber falls to much lower values than the pressure of the fuel in the injection chamber and the pin is displaced upwards into the open position by the effect of the hydraulic force that is generated by the difference in pressure.

Another example of an injector with hydraulic pin actuation is provided by patent application WO-0129395-A1, in which an upper portion of the pin is housed in the control chamber, while a lower portion of the pin is housed in an injection chamber, which is delimited below by the valve seat of the injection valve and houses the spring that holds the pin in the closed position; the control chamber is coupled to the control valve, which is actuated by a piezoelectric actuator so as to be displaced between a closed position, and an open position, in which it puts the control chamber in communication with a low-pressure drainage environment.

Patents U.S. Pat. No. 5,664,545-A1, DE-1016484-A, EP-0851115-A1 and EP-0999360-A1 supply further examples of injectors with hydraulic pin actuation.

The operation of the control spring is to hold the valve body of the control valve in the closed position with a predetermined elastic force that must be greater than the hydraulic force exerted by the fuel; clearly, the greater the working pressure of the fuel, the greater the elastic force that has to be exerted by the spring. As the working pressure of the fuel has gradually risen, higher-performance control springs are being used, capable of exerting ever-higher elastic forces; obviously, an increase in the elastic force exerted by the control spring that holds the valve body of the control valve in the closed position involves a corresponding increase in the force that has to be generated by the electromagnetic actuator of the control valve in order to move the control valve from the closed position to the open position. However, in known injectors with hydraulic pin actuation the increase in the force generated by the electromagnetic actuator of the control valve has proved problematic and has only been resolved by increasing the transverse dimension of the injectors.

As described by patent application IT-BO2002A000497, in order to obtain an increase in the force generated by the electromagnetic actuator of the control valve without a corresponding increase in the transverse dimension of the injector, a proposal has been made to use an electromagnetic actuator provided with a pair of electromagnets electrically independent of each other and provided with two respective moveable armatures, which are both mechanically connected to the valve body of the control valve. The electromagnetic actuator of the injector with hydraulic pin actuation described in patent application IT-BO2002A000497 is capable of producing a very great force while having a modest transverse dimension; however, such an actuator has proved relatively costly, complicated to assemble and complicated to develop.

GB2341893 relates to a two-stage electromagnetically actuated fuel injector for use in a common rail system of a i.c. engine. The fuel injector comprises a valve needle slidable in a bore and having an upper end exposed to pressure in a control chamber; the pressure in the control chamber is relieved by a valve to initiate injection. The valve member is movable by a first electromagnetic actuator which comprises a first component coupled to the valve member and a second component which is movable by a second electromagnetic actuator; thus injection can be made in two stages by energizing the actuator windings of the two actuators respectively. Alternatively, the valve member may be coupled to an armature movable by a single electromagnetic actuator having a winding located between relatively movable stator components defining respective pole faces which are spaced from the armature by different distances.

SUMMARY OF THE INVENTION

The aim of the present invention is to produce a fuel injector with hydraulic pin actuation that has none of the disadvantages described above and, in particular, is easy and economic to actuate.

According to the present invention, a fuel injector with hydraulic pin actuation is produced as claimed in the attached claims.

BRIEF DESCRIPTION OF THE DRAWINGS

The present invention will now be described with reference to the attached drawings, which illustrate a non-limiting embodiment thereof, in which.

DETAILED DESCRIPTION OF THE INVENTION

Figure 1:
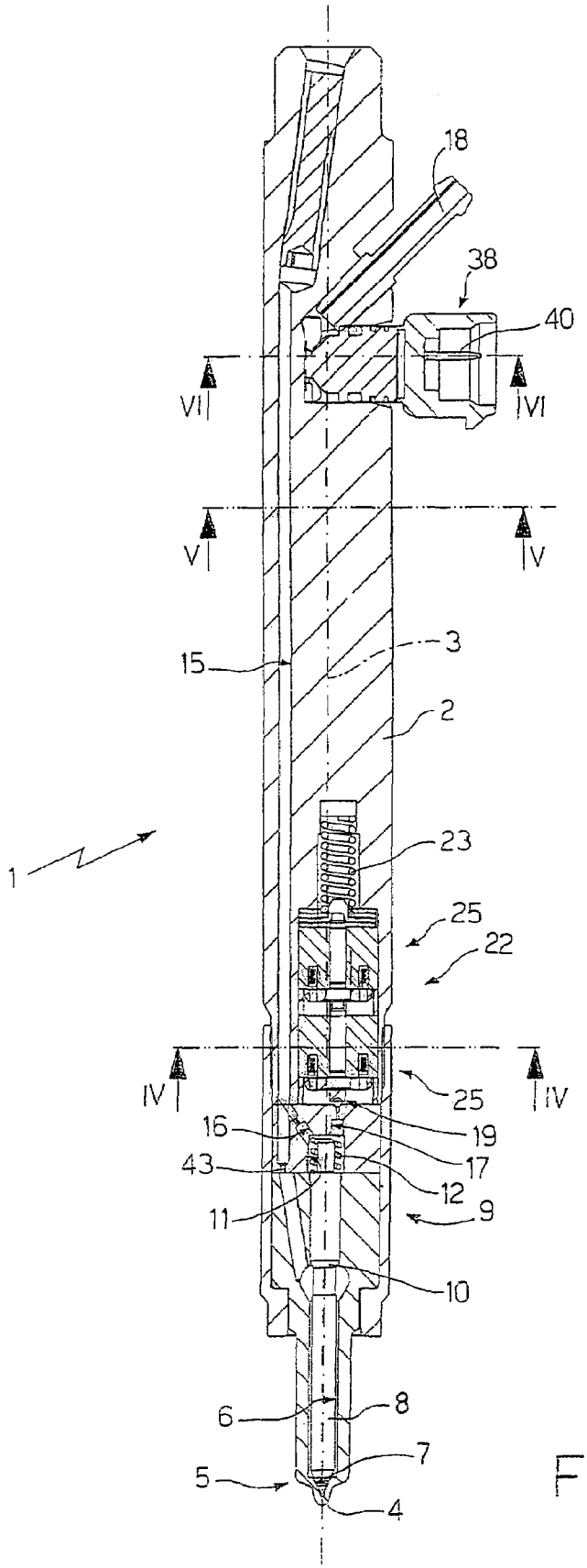
FIG. 1 is a schematic view, from the side and in cross section, of a fuel injector produced according to the present invention.

In FIG. 1 the reference number 1 indicates a fuel injector as a whole, which fuel injector is housed in a cylindrical body 2 having a longitudinal axis 3 and is capable of being controlled for injecting fuel by an injection nozzle 4 regulated by an injection valve 5. Inside the cylindrical body 2 an injection chamber 6 is produced, which is delimited below by a valve seat 7 of the injection valve 5 and houses, in a sliding manner, a lower portion of a pin 8 of the injection valve 5, in such a way that the pin 8 can be displaced along the longitudinal axis 3 when pushed by a hydraulic actuator device 9 between a position where the valve seat 7 is closed and a position where it is open; the lower portion of the pin 8 housed in the injection chamber 6 has a component 10 in the shape of a truncated cone, which reduces the section of said pin 8.

Figure 2:
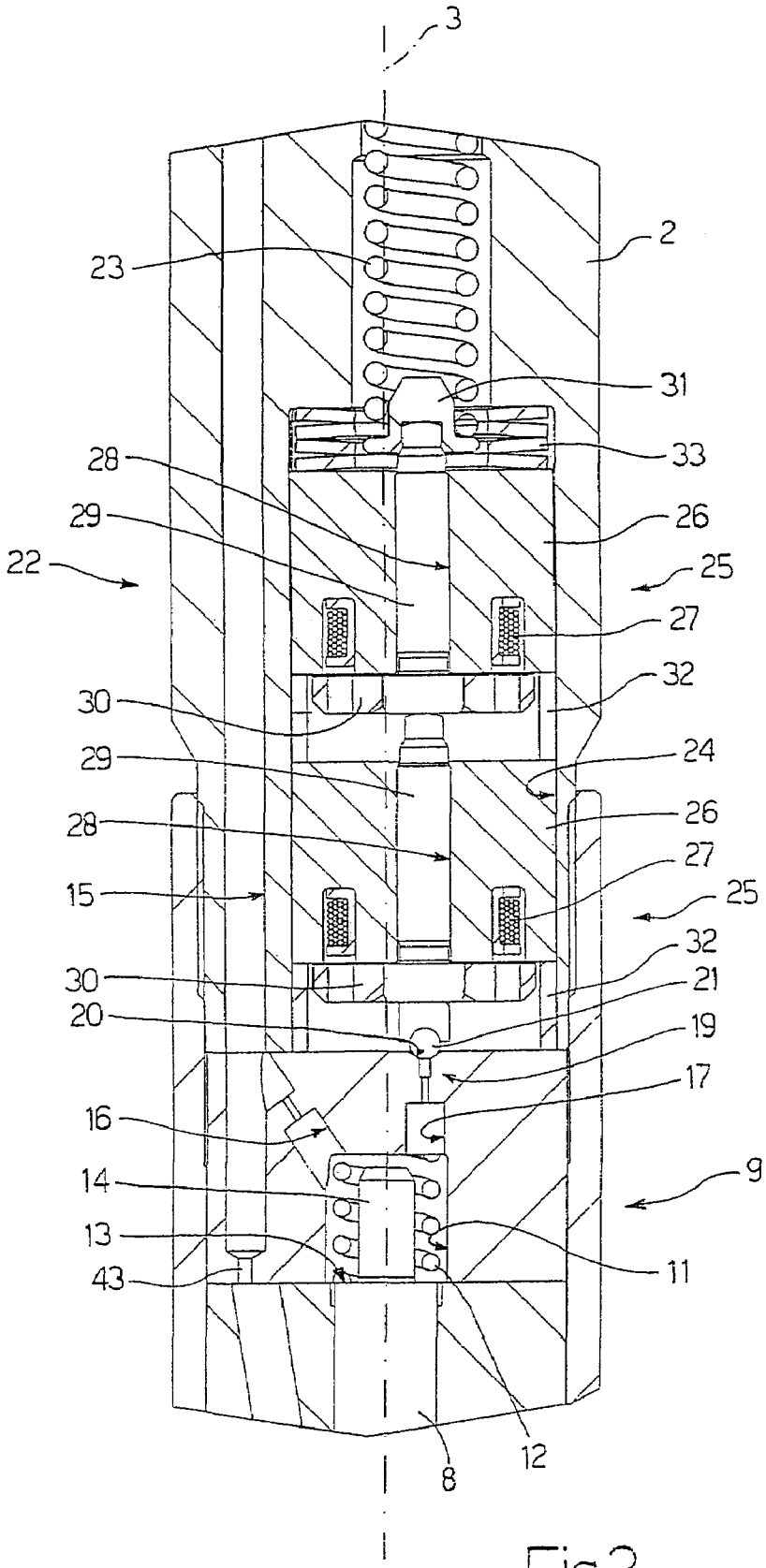
FIG. 2 is a view on an enlarged scale of a detail in FIG. 1.

As illustrated in FIG. 2, an upper portion of the pin 8 is housed in a control chamber 11 and is coupled to a spring 12 that exerts on said pin 8 a downward force that tends to hold said pin 8 in the aforementioned closed position. In particular, the upper portion of the pin 8 has a tapered shape with a further change in section, which produces a surface 13 in the shape of a circular crown, from the centre of which there rises a cylindrical body 14 having the function of limiting the upward travel of the pin 8 against an upper surface of the control chamber 11; the spring 12 is arranged coaxially with the cylindrical body 14 so as to be compressed between the surface 13 in the shape of a circular crown and the upper surface of the control chamber 11.

It should be noted that in the injection chamber 6 the useful area AU1 of the pin 8 on which the pressure of the fuel acts in order to determine a thrust along the longitudinal axis 3 is relatively small and is substantially equal to the sum of the area generated by the change in the section of the pin 8 in correspondence with the component 10 in the shape of a truncated cone and the area of the tip of the pin 8 not coupled to the valve seat 7 and immersed in the fuel; in contrast, in the control chamber 11 the useful area AU2 of the pin 8 on which the pressure of the fuel acts in order to determine a thrust along the longitudinal axis 3 is equal to the entire section of the pin 8 and is therefore greater than the useful area AU1 of the pin 8 in the injection chamber 6.

The cylindrical body 2 also has a supply line 15, which starts from an upper end of the cylindrical body 2 and is capable of feeding the pressurised fuel to the injection chamber 6; from the supply line 15 another supply line 16 branches off, which is capable of putting the supply line 15 in communication with the control chamber 11 in order to supply pressurised fuel also to the control chamber 11.

From the control chamber 11 a drainage duct 17 leaves, capable of putting the control chamber 11 in communication with a drain 18, which is arranged in an upper portion of the cylindrical body 2 and finishes in a fuel collection and recirculation environment substantially at ambient pressure (not illustrated); the drainage duct 17 is regulated by a control valve 19, which is arranged close to the control chamber 11 and is controlled between a closed position, in which the control chamber 11 is isolated from the drainage duct 17, and an open position, in which the control chamber 11 is connected to the drainage duct 17.

The control valve 19 comprises a valve seat 20 produced along the drainage duct 17 and a valve body 21, which has a spherical shape and is moveable in a direction parallel to the longitudinal axis 3 from an engaged position (corresponding to the control valve 19 being closed) and a disengaged position (corresponding to the control valve 19 being open) of the valve seat 20 when being pushed by an electromagnetic actuator device 22 against the action of a spring 23 that tends to keep the valve body 21 in the engaged position. The control valve 19 is entirely housed along the drainage duct 17, which, for this reason, has a cylindrical chamber 24 in order to accommodate the actuator device 22.

The electromagnetic actuator device 22 comprises two electromagnets 25, which are identical to each other, are electrically independent of each other and are both mechanically connected to the valve body 21 of the control valve 19 in order to displace the valve body 21 from the engaged position to the disengaged position against the action of the spring 23. In particular, each electromagnet 25 comprises a magnetic nucleus 26 of toroid shape, which houses a respective coil 27 and has a central hole 28 in which a respective pin 29 is engaged; each pin 29 is mounted in a sliding manner inside the corresponding central hole 28 and is integral with a respective armature 30 made of ferromagnetic material, which is magnetically attracted to the magnetic nucleus 26 when the relative coil 27 is energised.

The pin 29 of the lower electromagnet 25 on the one hand bears against the valve body 21 of the control valve 19 and on the other hand bears against the pin 29 of the upper electromagnet 25; the pin 29 of the upper electromagnet 25 on the one hand bears against the pin 29 of the lower electromagnet 25 and on the other hand bears against one end of the spring 23 by the interposition of a cup-type connection component 31. It is important to note that the pin 29 of the lower electromagnet 25 bears against and is not fixed to the valve body 21 of the control valve 19 so as to define an articulation capable of making up for any errors of alignment; moreover, it should be noted that the valve body 21 and the pins 29 are held together by the opposing forces of pressure exerted by the fuel on the valve body 21 and by the spring 23.

Inside the chamber 24, the magnetic nuclei 26 of the electromagnets 25 are held in position by a pair of annular positioning components 32 and by at least one Belleville spring 33 that is compressed between an upper wall of the chamber 24 and a base surface of the magnetic nucleus 26 of the upper electromagnet 25; in particular, a positioning component 32 is arranged between the magnetic nuclei 26 of the two electromagnets 25, and the other positioning component 32 is arranged between a base surface of the magnetic nucleus 26 of the lower electromagnet 25 and a lower wall of the chamber 24. It should be noted that the positioning components 32 also perform the function of recording the travel of the armatures 30.

It is clear from the above that the two electromagnets 25 are stacked on top of one another and are arranged mechanically in series with each other so that the respective thrust forces are added together.

Figure 4:
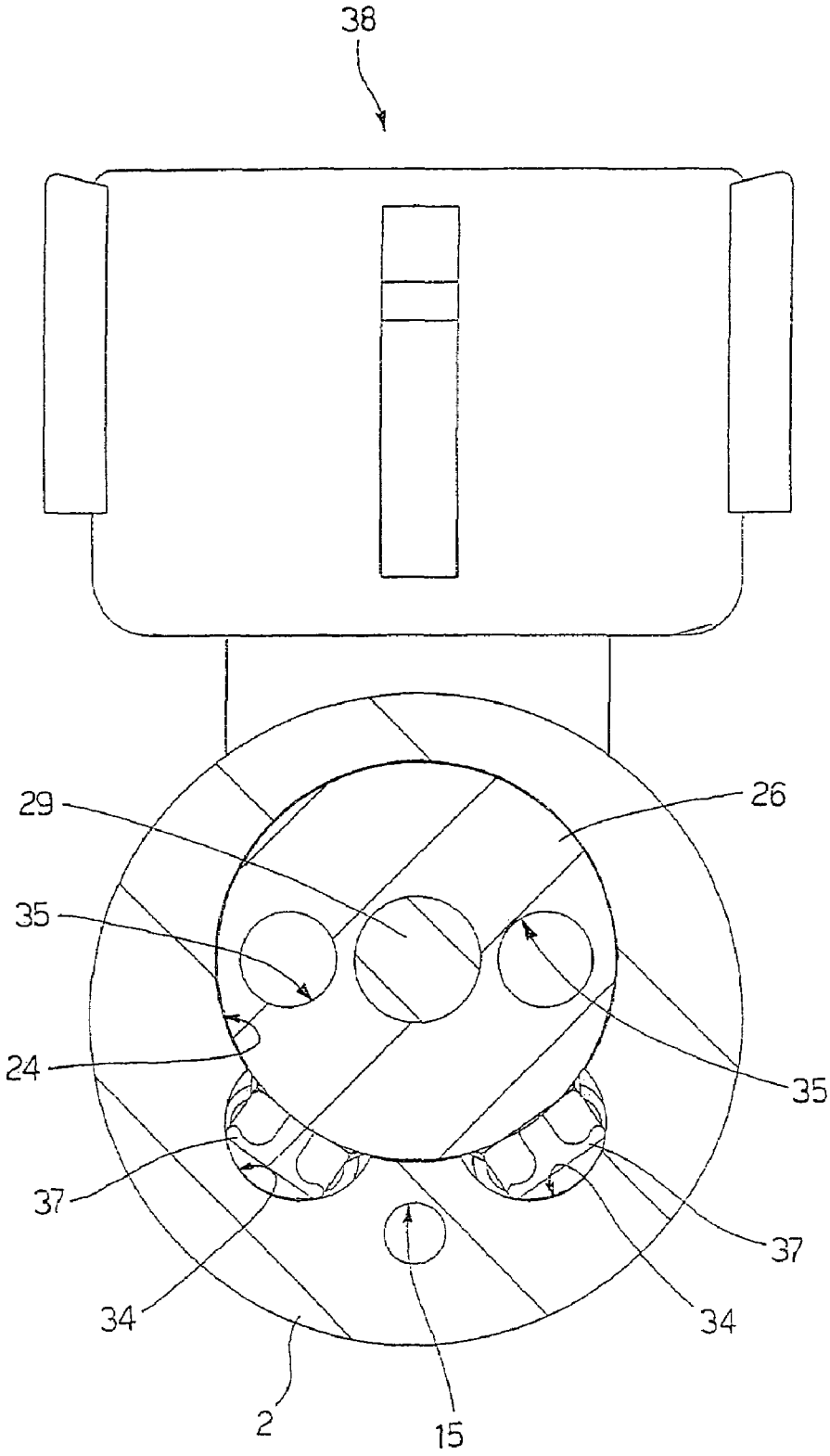
FIG. 4 is a view on an enlarged scale and in cross section along the line IV—IV of the injector in FIG. 1.
Figure 5:
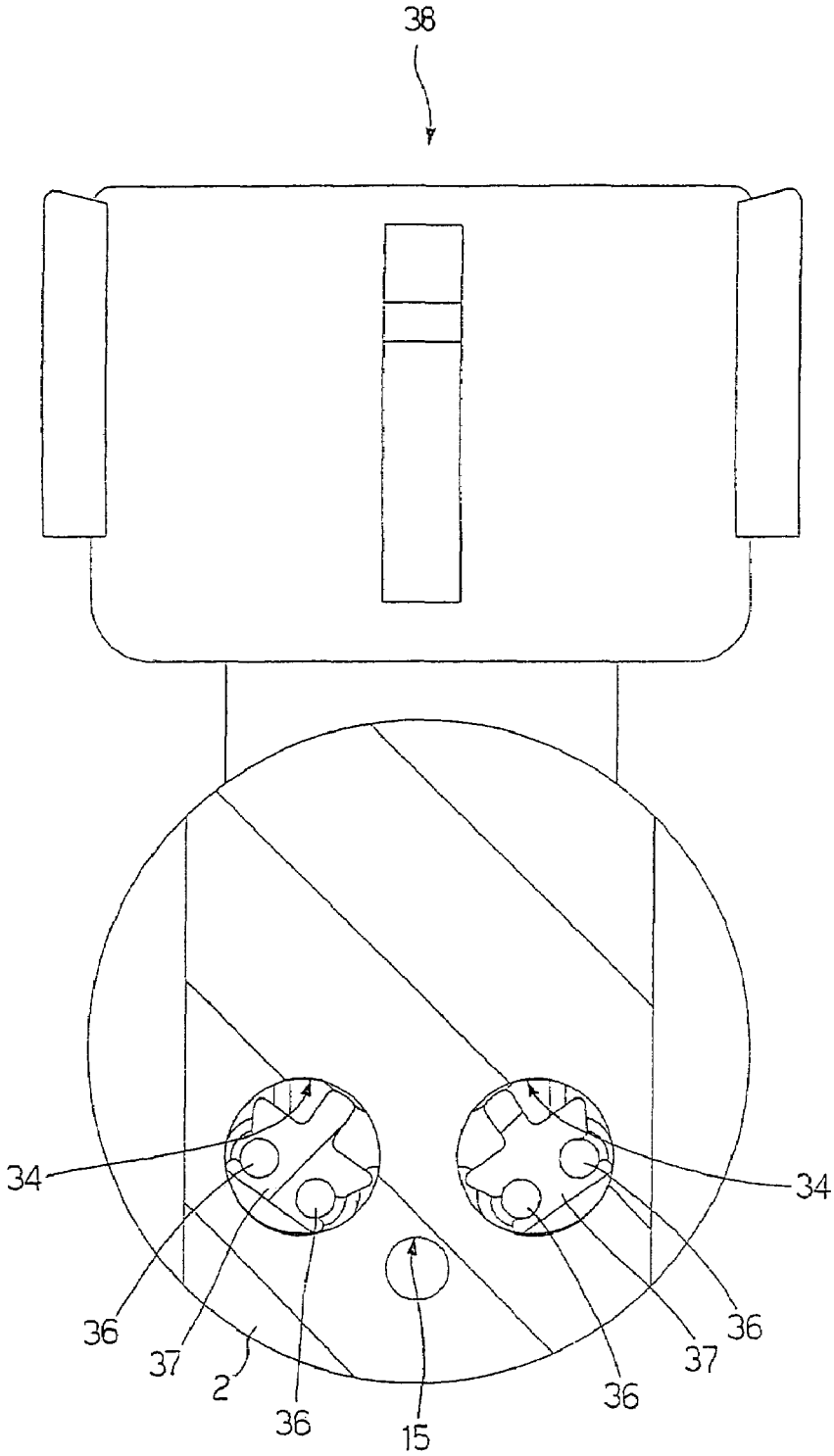
FIG. 5 is a view on an enlarged scale and in cross section along the line V—V of the injector in FIG. 1.
Figure 6:
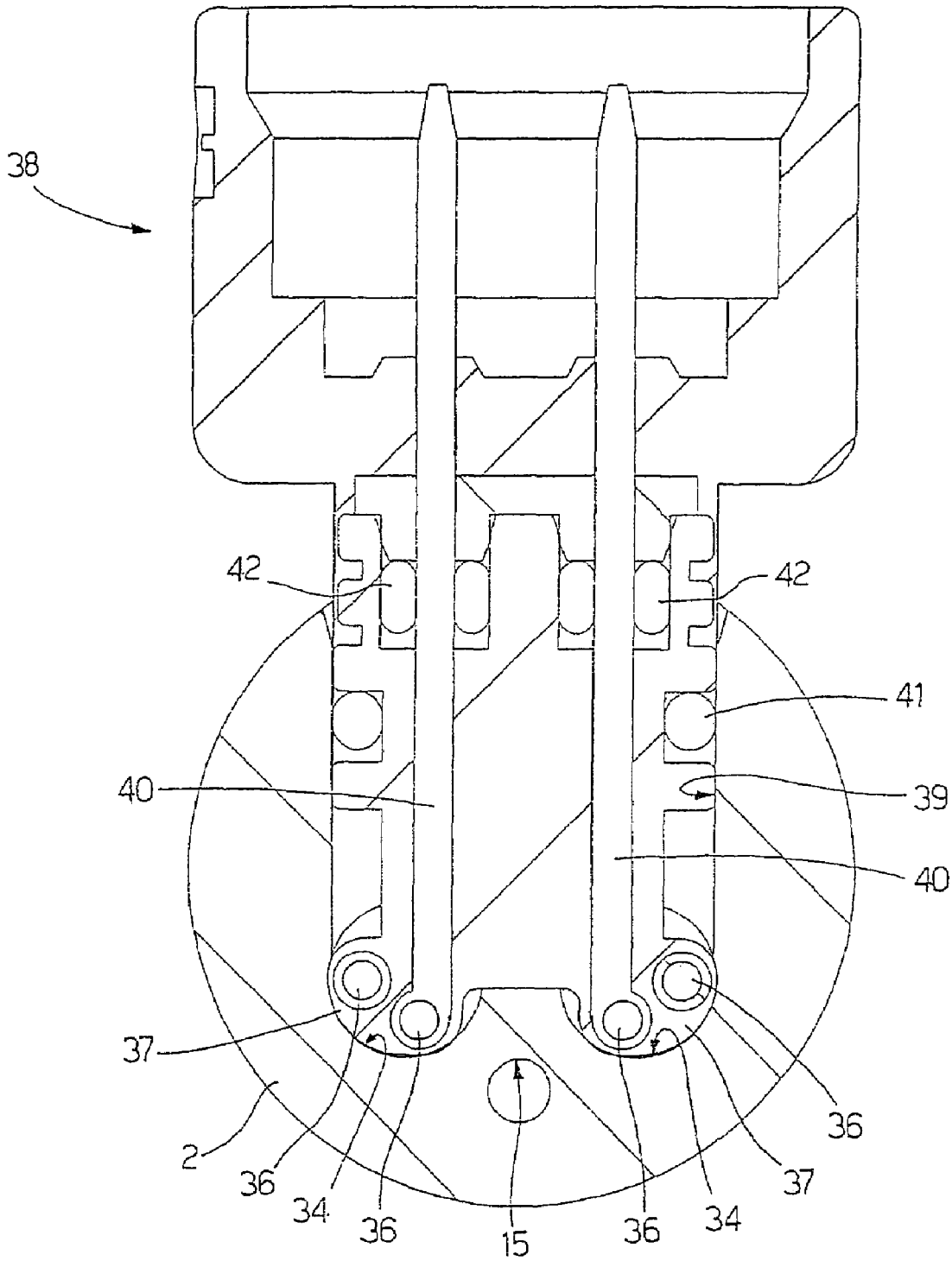
FIG. 6 is a view on an enlarged scale and in section along the line VI—VI of the injector in FIG. 1.

As illustrated in FIGS. 4, 5 and 6, the drainage duct 17 comprises two channels 34, which are parallel to the longitudinal axis 3 of the injector 1 and extend from the chamber 24 to the drain 18; each channel 34 has a semicircular section in correspondence with the chamber 24 and has a circular section between the chamber 24 and the drain 18. The armatures 30 of the two electromagnets 25 have a respective pair of through-holes 35 (illustrated in FIG. 4) in order to control the permeability of said armatures 30 during their displacement.

One purpose of the channels 34 of the drainage duct 17 is to allow the passage of a flow of fuel through the chamber 24 to the drain 18; moreover, inside each channel 34, a pair of electrical conductors 36 is housed, supplying the coil 27 of a respective electromagnet 25. Obviously, inside each channel 34 the two electrical conductors 36 are insulated from one another and are isolated from the fuel by the interposition of a respective insulating component 37. Each pair of electrical conductors 36 extends between the respective coil 27 and an electrical connector 38, which is arranged in the upper portion of the cylindrical body 2 immediately below the drain 18.

Figure 3:
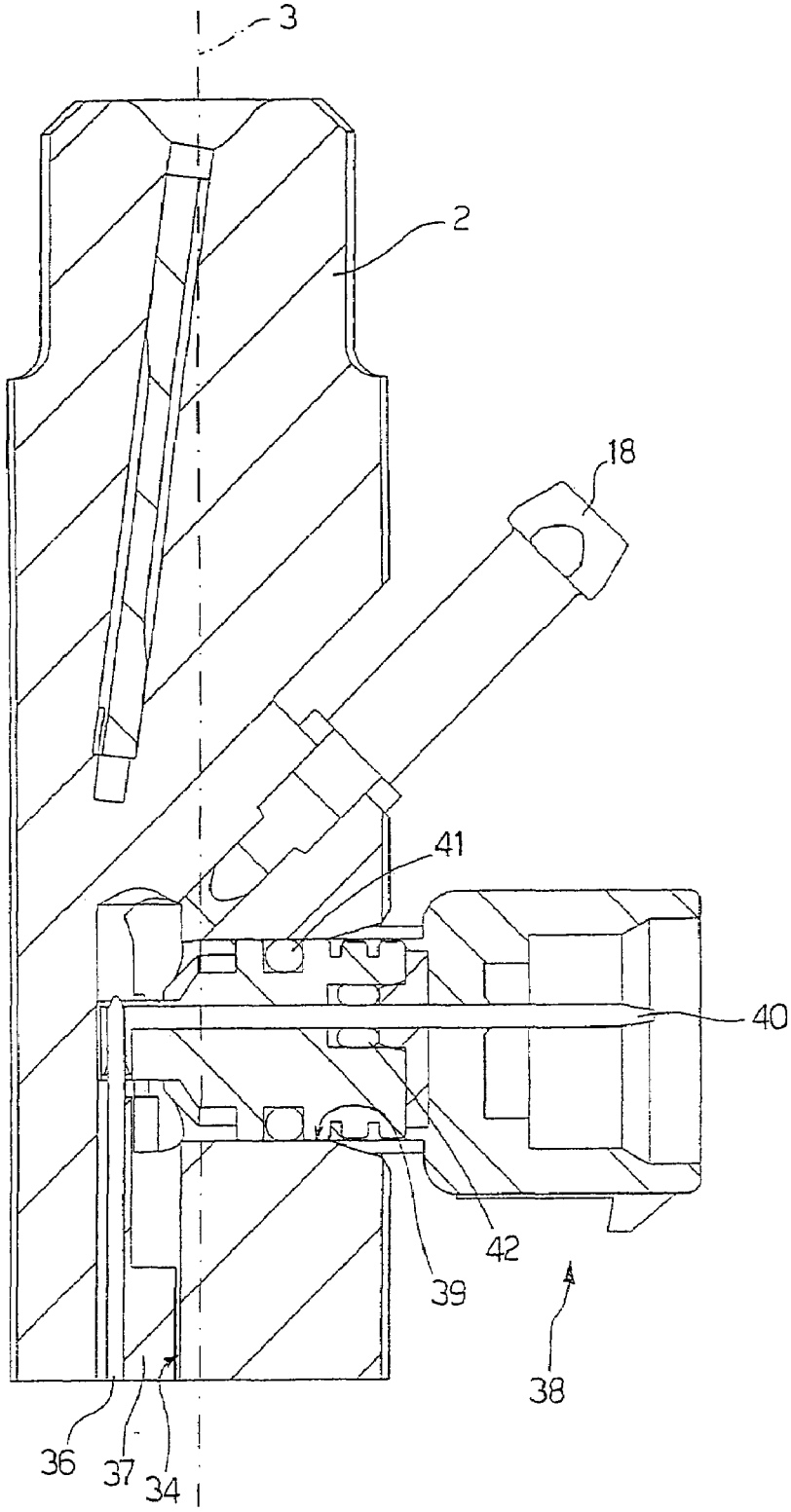
FIG. 3 is a view on an enlarged scale of a further detail in FIG. 1.

As illustrated in FIGS. 3 and 6 the electrical connector 38 is capable of being inserted, sealed off from the fuel, inside a respective hole 39 perpendicular to the longitudinal axis 3 of the injector 1; in particular, the electrical connector 38 comprises a pair of electrical contacts 40, which extend along the whole electrical connector 38 and on one side they bear against the electrical conductors 36 and on the opposite side they are free in the air and can be coupled with a female electrical connector (not illustrated) supplying the injector 1. It should be noted that the electrical contacts 40 are shaped so as to connect the two coils 27 together in series or parallel; for example, where the two coils 27 are connected in parallel, each electrical contact 40 bears against an electrical conductor 38 of one coil 27 and against an electrical conductor 38 of the other coil 27. In another embodiment, the hole 39 housing the electrical connector 38 forms an angle other than 90° with the longitudinal axis 3 of the injector 1; for example, the hole 39, and therefore the electrical connector 38, could form an angle of 45° with the longitudinal axis 3 of the injector 1.

In order to ensure that the fuel is sealed off from the electrical connector 38, there is an elastic sealing ring 41 between the electrical connector 38 and the hole 39, and there is an elastic sealing ring 42 around each electrical contact 40. Preferably, the electrical connector 38 is blocked inside the hole 39 by a retaining trip device (known and not illustrated) or by another similar retaining device.

The section of the supply line 16, the section of the control valve 19 and the section of the drainage duct 17 are given dimensions relative to the section of the supply line 15 so as to ensure that when the control valve 19 is open the pressure of the fuel in the control chamber 11 falls to much lower values than the pressure of the fuel in the injection chamber 6 and in order to ensure that the flow rate of fuel through the drainage duct 17 is a substantially negligible fraction of the flow rate of fuel through the injection nozzle 4.

In use, when the electromagnets 25 are de-energised, the force generated by the spring 23 holds the control valve 19 in the closed position; therefore, the pressure of the fuel in the control chamber 11 is the same as the pressure of the fuel in the injection chamber 6 through the effect of the supply line 16. In this situation, the force generated by the spring 12, and the hydraulic force generated by the imbalance between the useful areas AU1 and AU2 of the pin 8, to the advantage of the control chamber 11, and the injection chamber 6, keep the injection valve 5 in the aforementioned closed position.

When the electromagnets 25 are energised by means of circulating electrical current, the control valve 19 is moved to the open position as described above, therefore the control chamber 11 is put into communication with the drain 18 and the pressure of the fuel in the control chamber 11 falls to much lower values than the pressure of the fuel in the injection chamber 6; as stated previously, the difference between the pressures of the fuel in the injection chamber 6 and the control chamber 11 is due to the dimensions of the sections of the supply line 16, the control valve 19 and the drainage duct 17 in comparison with the section of the supply line 15.

Through the effect of the imbalance between the pressures of the fuel in the injection chamber 6 and the control chamber 11, a hydraulic force is generated on the pin 8, which force is capable of displacing the pin 8 upwards against the action of the spring 12 so as to move the injection valve 5 to the aforementioned open position and to allow the injection of the fuel through the injection nozzle 4.

When the electromagnets 25 are de-energised, the force generated by the spring 23 returns the control valve 19 to the closed position; therefore, the pressure of the fuel in the control chamber 11 tends to rise until it reaches the pressure of the fuel in the injection chamber 6. In this situation, the force generated by the spring 12, and the hydraulic force generated by the imbalance between the useful areas AU1 and AU2 of the pin 8, to the advantage of the control chamber 11, and the injection chamber 6, return the injection valve 5 to the aforementioned closed position.

Preferably, the supply line 15 has a throat 43, which is arranged downstream of where the supply line 16 branches off, and is capable of instantaneously increasing the difference in pressure between the control chamber 11 and the injection chamber 6 during the transitory moment when the pin 8 closes (when the pin passes from the position where the valve seat 7 is open to the position where it is closed) in order to increase the force acting on the pin 8 and, therefore, to speed up the closing of said pin 8.

According to another embodiment not illustrated, more than two electromagnets 25, connected mechanically in series, are used according to the method described above; by way of example, three or four electromagnets 25 connected mechanically in series could be used. Obviously, such an embodiment is used when it is necessary for the electromagnetic actuator 22 to be capable of generating a very great force.

Experimental tests have demonstrated that the injector 1 described above has optimal dynamic characteristics, even when operating with very high fuel pressures, and it proves economical, compact and easy to produce. Any error in the size of the air gap of the armatures 30 is reduced to a minimum, consequently limiting the structural dispersions of the injector 1. Finally, through the configuration described above, a reduction of the total mass of the moveable part is obtained with beneficial effects in reducing the phenomenon of bounce in the control valve 19; in this way, the metering of the fuel is always very accurate and in particular a series of pilot fuel preinjections can be performed accurately and in rapid sequence, marked by a very short injection time.

It should be noted that the two electromagnets 25 are perfectly identical to each other and that, for each electromagnet 25, the respective armature 30 is guided by the corresponding pin 29. This detail proves to be important, since it allows each armature 30 to be coupled with its own magnetic nucleus 26 before inserting said armature 30 inside the injector 1; in this way, any error made in the dimensions of the relative air gap is reduced.

The invention claimed is:

1. Fuel injector (1) comprising:

a cylindrical body (2), which houses an injection nozzle (4) regulated by an injection valve (5) provided with a moveable pin (8);

a first fuel supply line (15);

an injection chamber (6) communicating with the first supply line (15), housing a lower portion of the pin (8) and delimited below by a valve seat (7) of the injection valve (5);

a control chamber (11) communicating with the first supply line (15) and housing an upper portion of the pin (8); and a control valve (19), which is actuated by an electromagnetic actuator (22) in order to be displaced from an open position, in which it puts the control chamber (11) in communication with a drain (18) for the fuel at low pressure, against the action of a first spring (23); wherein the electromagnetic actuator (22) comprises at least two electromagnets (25), which are identical to each other, are stacked on top of each other and are arranged mechanically in series with each other so that the respective thrust forces are added together;

the injector (1) being characterised by the fact that each electromagnet (25) comprises a magnetic nucleus (26) of toroid shape, which houses a respective coil (27) and has a central hole (28) in which a respective pin (29) is engaged; each pin (29) being mounted in a sliding manner inside the corresponding central hole (28) and being integral with a respective armature (30) made of ferromagnetic material, which is magnetically attracted to the magnetic nucleus (26) when the relative coil (27) is energised; the pin (29) of a lower electromagnet (25) on the one hand bearing against a valve body (21) of the control valve (19) and on the other hand bearing against the pin (29) of an upper electromagnet (25); the pin (29) of the upper electromagnet (25) on the one hand bearing against the pin (29) of the lower electromagnet (25) and on the other hand bearing against one end of the first spring (23).

2. Injector according to claim 1, in which a drainage channel (17) is provided, which is capable of putting the control chamber (11) in communication with the drain (18), is regulated by the control valve (19) and has a chamber (24) housing the electromagnetic actuator (22); the magnetic nuclei (26) of the electromagnets (25) are held in position by a pair of annular positioning components (32) and by at least one Belleville spring (34), which is compressed between an upper wall of the chamber (24) and a base surface of the magnetic nucleus (26) of the upper electromagnet (25).

3. Injector according to claim 2, in which each positioning component (32) also performs the function of recording the travel of a respective armature (30).

4. Injector according to claim 1, in which each armature (30) has at least one through-hole (35) in order to control the permeability of said armature (30) during the displacement thereof.

5. Injector according to claim 1, in which the lower portion of the pin (8) housed in the injection chamber (6) has a component (10) in the shape of a truncated cone, which reduces the section of said pin (8).

6. Injector according to claim 1, in which the upper portion of the pin (8) housed in the control chamber (11) is coupled to a second spring (12), which exerts on said pin (8) a force that tends to keep said pin (8) in a position where the injection nozzle (4) is closed.

7. Injector according to claim 6, in which the upper portion of the pin (8) has a tapered shape with a change of section that determines a surface (13) in the shape of a circular crown, from the centre of which there rises a cylindrical body (14) having the function of limiting the travel of the pin (8) against an upper surface of the control chamber (11); the second spring (12) being arranged around the cylindrical body (14) so as to be compressed between the surface (13) in the shape of a circular crown and the upper surface of the control chamber (11).

8. Injector according to claim 1, in which the injection chamber (6) is supplied directly by the first supply line (15); a second fuel supply line (16) being provided, which branches off from the first supply line (15) and is capable of putting the first supply line (15) in communication with the control chamber (11); the first supply line (15) having a throat (43), which is arranged downstream of where the second supply line (16) branches off.

9. Injector according to claim 1, in which a drainage channel (17) is provided, which channel is capable of putting the control chamber (11) in communication with the drain (18), is regulated by the control valve (19) and comprises two channels (34) that extend as far as the drain (18).

10. Injector according to claim 9, in which, inside each channel (34), a pair of electrical conductors (36) is housed, supplying a respective electromagnet (25).

11. Injector according to claim 10, in which, inside each channel (34), the two electrical conductors (36) are insulated from each other by the interposition of a respective insulating component (37).

12. Injector according to claim 10, comprising an electrical connector (38) capable of being inserted, sealed off from the fuel, inside a respective hole (39); each pair of electrical conductors (36) extending between the respective electromagnet (25) and the electrical connector (38).

13. Injector according to claim 12, in which the electrical connector (38) forms an angle of 90° with a longitudinal axis (3) of the injector (1).

14. Injector according to claim 12, in which the electrical connector (38) comprises a pair of electrical contacts (40), which extend along the whole electrical connector (38) and on one side bear against the electrical conductors (36) and on the opposite side are free in the air and can be coupled with a female electrical connector supplying the injector (1).

15. Injector according to claim 14, in which the electrical contacts (40) are shaped so as to connect together the two electromagnets (25) in series or in parallel.

16. Injector according to claim 14, in which there is a first elastic sealing ring (41) between the electrical connector (38) and the hole (39), and there is a second elastic sealing ring (42) around each electrical contact (40).

17. Injector according to claim 1, comprising an electrical connector (38), which is capable of being inserted inside a respective hole (39).

18. Injector according to claim 17, in which the electrical connector (38) forms an angle of 90° with a longitudinal axis (3) of the injector (1).

19. Injector according to claim 1, in which the electromagnetic actuator (22) comprises three electromagnets (25), which are identical to each other, are stacked on top of one another and are arranged mechanically in series with each other so that the respective thrust forces are added together.

20. Fuel injector (1) comprising:

a cylindrical body (2), which houses an injection nozzle (4) regulated by an injection valve (5) provided with a moveable pin (8);

a first fuel supply line (15);

an injection chamber (6) communicating with the first supply line (15), housing a lower portion of the pin (8) and delimited below by a valve seat (7) of the injection valve (5);

a control chamber (11) communicating with the first supply line (15) and housing an upper portion of the pin (8); and a control valve (19), which is actuated by an electromagnetic actuator (22) in order to be displaced from an open position, in which it puts the control chamber (11) in communication with a drain (18) for the fuel at low pressure, against the action of a first spring (23); wherein the electromagnetic actuator (22) comprises at least two electromagnets (25), which are identical to each other, are stacked on top of each other and are arranged mechanically in series with each other so that the respective thrust forces are added together;

the injector (1) being characterised by the fact that a drainage channel (17) is provided, which channel is capable of putting the control chamber (11) in communication with the drain (18), is regulated by the control valve (19) and comprises two channels (34) that extend as far as the drain (18); inside each channel (34), a pair of electrical conductors (36) being housed, supplying a respective electromagnet (25).

21. Injector according to claim 20, in which, inside each channel (34), the two electrical conductors (36) are insulated from each other by the interposition of a respective insulating component (37).

22. Injector according to claim 20, comprising an electrical connector (38) capable of being inserted, sealed off from the fuel, inside a respective hole (39); each pair of electrical conductors (36) extending between the respective electromagnet (25) and the electrical connector (38).

23. Injector according to claim 22, in which the electrical connector (38) forms an angle of 90° with a longitudinal axis (3) of the injector (1).

24. Injector according to claim 22, in which the electrical connector (38) comprises a pair of electrical contacts (40), which extend along the whole electrical connector (38) and on one side bear against the electrical conductors (36) and on the opposite side are free in the air and can be coupled with a female electrical connector supplying the injector (1).

25. Injector according to claim 24, in which the electrical contacts (40) are shaped so as to connect together the two electromagnets (25) in series or in parallel.

26. Injector according to claim 24, in which there is a first elastic sealing ring (41) between the electrical connector (38) and the hole (39), and there is a second elastic sealing ring (42) around each electrical contact (40).

* * * * *